United States Patent [19]

Asai et al.

[11] 3,968,957

[45] July 13, 1976

[54] GAS CARBURIZING FURNACE

[75] Inventors: Takeji Asai; Kaishu Yamazumi, both of Toyama, Japan

[73] Assignee: Kabushiki Kaisha Fujikoshi, Toyama, Japan

[22] Filed: Sept. 10, 1975

[21] Appl. No.: 612,186

[30] Foreign Application Priority Data

Apr. 9, 1975 Japan ..... 50-43500

[52] U.S. Cl. ..... 266/257; 23/281; 266/287

[51] Int. Cl.[2] ..... C21D 1/74

[58] Field of Search ..... 23/281; 266/257, 287

[56] References Cited

UNITED STATES PATENTS 975,077 11/1910 Rockwell ..... 266/257 X 3,917,238 11/1975 Gohring ..... 266/257

*Primary Examiner*—Granville Y. Custer, Jr.
*Assistant Examiner*—Paul A. Bell
*Attorney, Agent, or Firm*—Spensley, Horn & Lubitz

[57] ABSTRACT

A gas carburizing furnace wherein the liquid organic composition is introduced into the furnace through a perforated container contained therein. The perforated container comprises a thermal plate at the bottom and perforated walls made from a catalytic material. Therefore, the liquid organic composition entering the container through the dropping port is vaporized when it comes in contact with the hot thermal plate and is cracked while passing through the perforations in the catalytic material.

5 Claims, 2 Drawing Figures

GAS CARBURIZING FURNACE

BACKGROUND OF THE INVENTION

1. Field of the Invention

This invention relates to a gas carburizing furnace, and, more particularly, to an improvement of a drip-fed type gas carburizing furnace.

2. Description of the Prior Art

It is a well-known method for carburizing or carbonitriding steels to supply liquid organic composition directly to the atmosphere of the furnace. One example of such a method comprises the steps of preparing a liquid organic composition to generate the raw material gases, said composition having a carbon oxygen atomic ratio (C/O) of 1.5 to 3.0, detecting the equilibrium carbon concentration of the steel surface in the carburizing atmosphere by means of a specially prepared alloyed wire, and automatically controlling the inflow of the liquid organic composition thereby gas carburizing or gas carbonitriding steels in an atmospheric furnace in which the equilibrium carbon concentration of the steel surface is automatically maintained at a desired level. The Applicant has filed a patent application in Japan (Ser. No. 66-77756) in connection with the above-stated method as well as the device to control the carbon concentration and a device to control the inflow rate of the carburizing mixture. While this method and device provides may advantages regarding the automatic control system over the prior art methods, there remains some unsolved problems. First, it is likely that the method suffers from insufficient thermal cracking of the organic composition. Secondly, an undesirable amount of soot may occur during the carburizing operation.

BRIEF SUMMARY OF THE INVENTION

In keeping with the principals of the present invention, the objects accomplished with the unique combination of a perforated container having its walls made from a catalytic material and its bottom a thermal plate and a carburizing furnace. Since the container is mounted directly under the dropping port for the liquid organic composition being introduced into the carburizing furnace, the liquid organic composition comes in contact with the hot thermal plate thereby vaporizing it. The vaporized organic composition passes through the perforations in the catalytic material thereby promoting thermal cracking by the catalytic action.

Accordingly, it is a general object of the present invention to provide a gas carburizing furnace with improved thermal cracking of the liquid organic composition.

It is another object of the present invention to provide a gas carburizing furnace with improved vaporization of the liquid organic composition.

It is still another object of this invention to provide a gas carburizing furnace which promotes the thermal cracking of the vaporized organic composition without generating an undesirable amount of soot.

BRIEF DESCRIPTION OF THE DRAWINGS

The above-mentioned and other features and objects of the present invention will become more apparent by reference to the following description taken in conjunction with accompanying drawings, wherein like reference numerals denote like elements, and in which.

DETAILED DESCRIPTION OF THE PREFERRED EMBODIMENT

Figure 1:
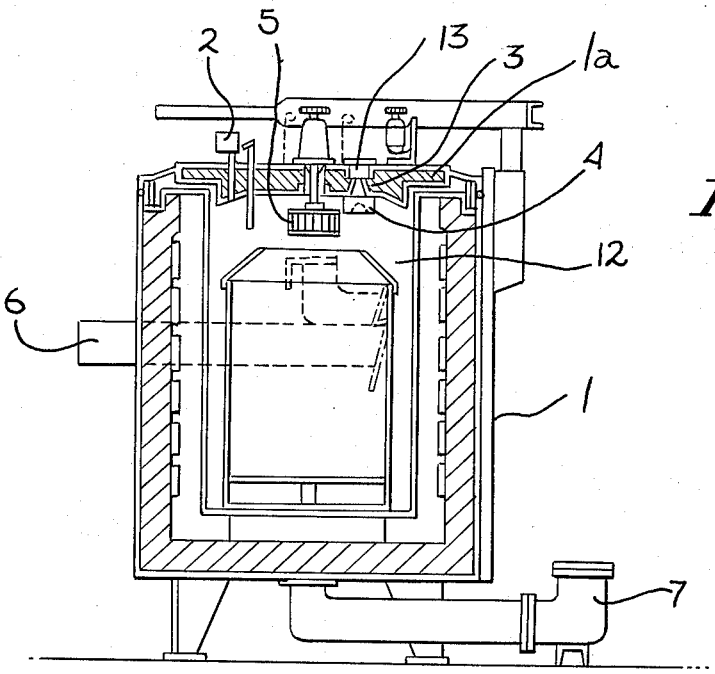
FIG. 1 is a simplified cross-sectional view of a gas carburizing furnace in accordance with the teachings of the present invention.

For the purpose of gaining a better understanding of the subject invention, reference is first made to the liquid organic composition utilized in the carburizing furnace. The material to be used in the subject invention consists of at least one type of liquid organic composition which is so prepared as to have a carbon-oxygen (C/O) ratio of 1.5 to 3.0. Such composition when mixed together is ready for thermal cracking. Examples of the composition are listed below as follows:

| | | |
|---|---|---|
| C/O = 1.5 | $CH_3OH$ | 3 mol |
| | $C_3H_7OH$ | 1 mol |
| C/O = 2.0 | $CH_3OH$ | 1 mol |
| | $C_3H_7OH$ | 1 mol |
| | $CH_3COOC_2H_5$ | 1 mol |
| C/O = 2.5 | $C_3H_7OH$ | 2 mol |
| | $CH_3COOC_2H_5$ | 1 mol |
| C/O = 3.0 | $C_3H_9OH$ | 3 mol |
| | $CH_3COOC_2H_5$ | 1 mol |

As shown above, the liquid organic material may be easily adjusted to have any desired C/O ratio between 1.5 and 3.0 by varying the mol ratio of different compounds in accordance with the capacity and inside structure of the furnace. Although the gas composition formed by the thermal cracking of the liquid organic composition changes slightly according to the cracking temperature, said changes in composition are inherent to the composition and dependent upon the cracking temperature. Since the component compounds of the composition stimulate each other during cracking, the thermal cracking is efficiently performed and a constant stable carburizing atmosphere is quickly obtained. Furthermore, it is possible to obtain a carbonitriding atmosphere by adding any liquid organic compound containing nitrogen aminos, for example, to the carburizing mixture previously prepared to have a suitable C/O ratio. The addition of the aminos will prevent the occurrence of uneven carburizations and also improves the surface hardness of treated steels where a high equilibrium carbon concentration in the surface of the steel is required, a situation where a substantial amount of soot would likely be produced.

The carburizing mixture is automatically supplied into the furnace to keep a constant carbon concentration by means of a flow controlled device. The flow controlled device comprises, in parallel, a main pipe with a valve to control the flow of the mixture for keeping the carbon concentration below a certain limit, a second pipe with a valve to shut off the flow when the carbon concentration becomes higher than an upper limit, and a third pipe with a valve to allow the flow into the furnace when the carbon concentration falls below a lower limit.

The carbon concentration is detected by a detector comprising a sensor consisting of a metal alloy wire having 5 to 10 percent nickel inserted in the furnace and a display-record means which transforms the output singal from the sensor to a display. The sensor has a constant current applied and detects any change in the resistance of the sensor due to carburizing and/or decarburizing thereof. The resistance value represents the equilibrium carbon concentration of the surface of the steel in the furnace. The sensor is also provided with a means to adjust for resistance changes due to temperature changes.

Figure 2:
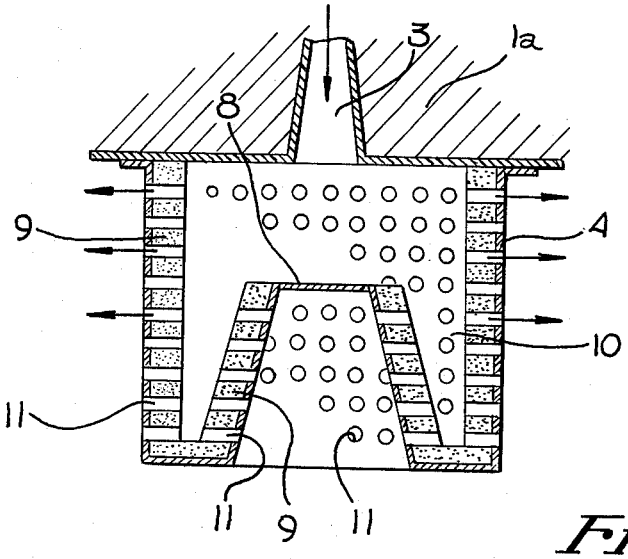
FIG. 2 is a simplified cross-sectional view of the vaporizing and catalyzing device in accordance with the teachings of the present invention.

In keeping with the principles of the present invention, the problems of the carburizing furnace have been substantially overcome with the embodiment discussed in conjunction with FIGS. 1 and 2.

Referring more specifically to the drawings, FIG. 1 is a pit-type carburizing furnace in accordance with the teachings of the present invention. The carburizing furnace 1 comprises a furnace cover 1*a* having a burning tube 2 and a dropping port 3 for supplying carburizing liquid therein. Furnace 1 is further provided with a vaporizing and catalyzing device 4 coupled to furnace cover l*a* and directly under dropping port 3. Furnace 1 is also provided with a fan 5 to circulate the gases inside the furnace, a cooling duct 6, and a cooling exhaust port 7.

The invention is best understood by referring to FIG. 2 in which a simplified enlarged cross-section view of the vaporizing and catalyzing device 4 is shown. Device 4 comprises a thermal plate directly under dropping port 3. The thermal plate is coupled to the bottom of a housing 12. The housing 12 is coupled to the interior of furnace cover 1*a*. The interior of housing 12 is covered with a porous refractory material 9. The porous refractory material 9 may contain a catalyst such as nickel. A chamber 10 is defined by the interior of material 9, the interior side of thermal plate 8, and the interior of furnace cover 1*a*. Material 9 together with housing 12 have a plurality of holes 11 therethrough by which chamber 10 communicates with the interior of furnace 1.

In operation, the liquid organic composition flows through the dropping port 3 onto the hot thermal plate 8 thereby vaporizing the liquid organic composition. The vaporized oganic composition passes through the holes 11 in material 9 and housing 12 thereby passing into furnace 1. As the vapor passes through holes 11 in material 9 containing a catalyst the vapor undergoes thermal cracking thereby supplying the needed carburizing gases.

In a pit-type furnace the vaporizing and catalyzing device 4 is installed under the dropping port 3 in furnace cover 1*a*. In an all-case-type furnace (not shown) the vaporizing and catalyzing device is mounted under the dropping port in the top of the carburizing chamber.

Since the vaporizing and catalyzing device is treated with hot air in a pit-type furnace, no soot will build up in the holes 11 and the device 4 will not require cleaning. However, if an all-case-type furnace is employed, soot will build up in the holes in the vaporizing and catalyzing device 4 and the soot will have to be burned out every one to three months. Also, in an all-case-type furnace the material 9 containing the catalyst must be thicker in order to perform efficient thermal cracking.

This invention has solved a number of outstanding problems by employing a vaporizing and catalyzing device which will maintain an even atmosphere in the furnace and prevent small temperature changes in the furnace due to endo-thermic reactions during cracking thereby facilitating thermal cracking and producing substantially no soot.

In all cases it is understood that the above-described embodiment is merely illustrative of but a small number of the many possible specific embodiments which can represent applications of the principles of the present invention. Numerous and various other arrangements can be readily devised in accordance with these principles by those skilled in the art without departing from the spirit and scope of the invention.

We claim:

1. A gas carburizing furnace having a dropping port to supply liquid organic composition into the interior of said furnace and a vaporizing and catalyzing device, the improvement comprising:

a thermal plate, said plate being directly under said dropping port; and a perforated housing, said housing being integral with and surrounding said thermal plate, said housing further being coupled to the interior of said furnace and together with said thermal plate and the interior of said furnace forms a chamber into which said liquid organic composition is supplied.

2. The gas carburizing furnace according to claim 1 wherein said house is lined with a porous refractory material.

3. The gas carburizing furnace according to claim 2 further comprising a catalyst in said porous refractory material.

4. The gas carburizing furnace according to claim 2 wherein said catalyst is nickel.

5. The gas carburizing furnace according to claim 1 wherein said housing is made from a porous refractory material.

* * * * *